United States Patent [19]

Turko et al.

[11] 4,263,890

[45] Apr. 28, 1981

[54] FLUE RESTRICTOR

[75] Inventors: John W. Turko, River Rouge; Maurice N. Day, Grosse Pointe Farms; Linda M. Deschere, Farmington Hills, all of Mich.; Howard B. Pritz, Columbus; Larry E. Schluer, Sugar Grove, both of Ohio; Henry F. Seidel, Detroit, Mich.; Sherwood G. Talbert, Columbus; Earl L. White, Worthington, both of Ohio

[73] Assignee: Michigan Consolidated Gas Company, Detroit, Mich.

[21] Appl. No.: 939,069

[22] Filed: Sep. 1, 1978

[51] Int. Cl.[3] ..... F23L 3/00

[52] U.S. Cl. ..... 126/295; 126/292; 110/147; 110/163

[58] Field of Search ..... 126/285 A, 285 B, 286, 126/293, 295, 292; 110/173, 163, 147; 138/44, 37

[56] References Cited

U.S. PATENT DOCUMENTS

| | | | |
|---|---|---|---|
| 83,139 | 10/1868 | Deilu . | |
| 154,039 | 8/1874 | Hager . | |
| 301,859 | 7/1884 | Cathcart . | |
| 310,224 | 1/1885 | Reed . | |
| 610,076 | 8/1898 | McClure . | |
| 736,513 | 8/1903 | Fowler | 126/285 A |
| 1,384,204 | 7/1921 | McMurdie | 126/285 A |
| 1,506,386 | 8/1924 | Schauman . | |
| 1,641,875 | 9/1927 | Beaulieu . | |
| 1,663,915 | 3/1928 | Mayers | 126/285 A |
| 3,273,625 | 9/1966 | Holtzman et al. | 126/293 X |

*Primary Examiner*—James C. Young
*Assistant Examiner*—Larry Jones
*Attorney, Agent, or Firm*—Harness, Dickey & Pierce

[57] ABSTRACT

A flue restrictor for installation in the flue piping of a heating system to reduce its effective cross sectional area comprises sheet metal inlet and outlet sections having flanges secured together in a joint that has a guideway in it for a sheet metal gate valve that may be transversely positioned to produce the desired cross-sectional area and riveted in place to provide a substantially tamper-proof assembly.

24 Claims, 10 Drawing Figures

FLUE RESTRICTOR

BRIEF SUMMARY OF THE INVENTION

It is the purpose of this invention to provide a device for controlling the draft in heating systems and, in particular, for reducing heat loss in many existing automatic heating systems using non-solid fuels, such as gas and liquified petroleum.

The invention accomplishes this purpose by means of a flue restrictor assembly that is adapted for retrofit, on-the-site installation in the flue piping of heating systems having excessive draft due to oversized chimneys and flue piping. This flue restrictor includes a housing that may be inserted in the flue piping to form a part thereof and a gate valve that is initially slidable in the housing so that the proper valve position for the desired draft control may be established, after which the valve may be locked to the housing to permanently set it in the desired position.

DESCRIPTION OF THE DRAWINGS

FIG. 9 is a side elevation of the restrictor, broken away and partly in section, showing fasteners rotated into the plane of the drawing for securing the housing to sections of the flue piping.

DETAILED DESCRIPTION OF THE INVENTION

Figure 1:
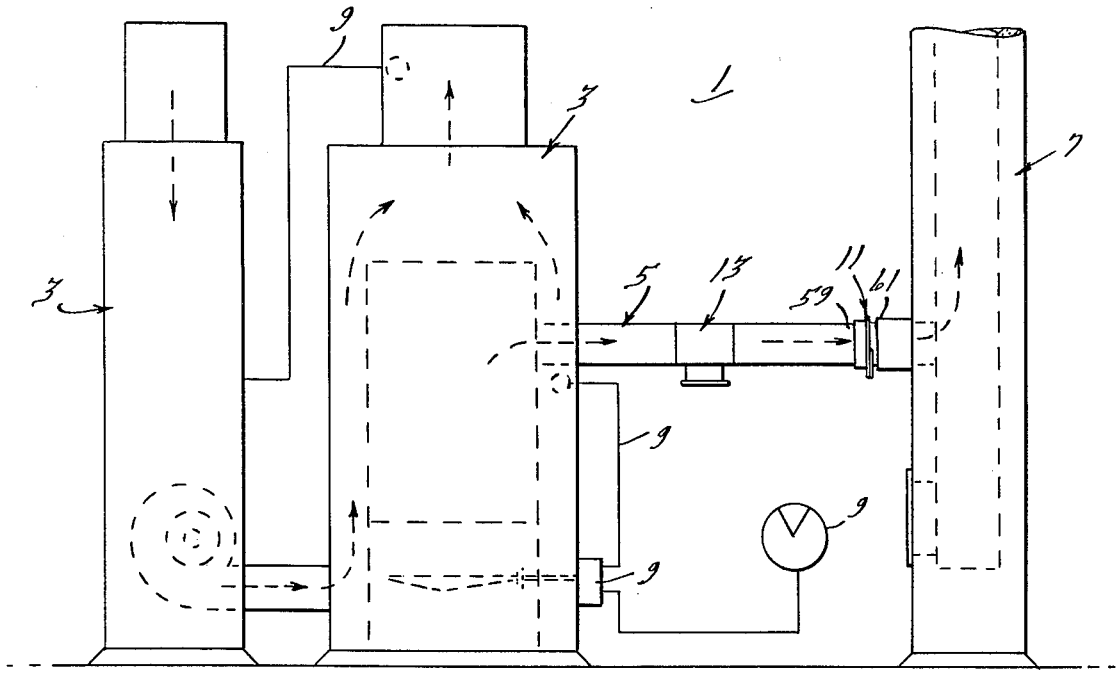
FIG. 1 is a diagrammatic side elevation of a forced air, gas fired furnace system for residential heating in which a flue restrictor embodying the invention has been installed, the arrows indicating the flow of air or combustion products.

A typical heating system 1 in which the invention may be used as illustrated in FIG. 1 and comprises a conventional heating appliance 3 connected by flue piping 5 to a chimney 7. The appliance 3 burns natural gas, propane, or liquified petroleum (i.e. non-solid fuel) and the system includes controls 9 to make its operation automatically responsive to heat demand. The heating appliance illustrated is a forced air, natural gas furnace for residential heating but the invention may be used with various other automatic gas or liquid fuel burning appliances such as warm air furnaces, steam or hot water boilers, hot water heaters, etc.

In accordance with the invention, a flue restrictor device 11 is installed in the flue piping 5 for the purpose of reducing the heat loss of the system through the piping 5 and chimney 7. Since the heating appliance is automatically operated, the restrictor 11 does not function to affect the rate of combustion or control the heat output of the system but provides a fixed orifice, calibrated to suit the system, which serves to control draft and limit the quantity of heated air drawn into the draft hood 13 during off and on cycles.

In the great majority of automatic gas or liquid fired heating appliances the rate of input of fuel is constant, so that it is possible and desirable to maintain a substantially constant draft from the chimney during operation. However, in heating systems installed prior to the recent shortage of natural gas and liquified petroleum fuels the chimneys have in general been oversized, in line with building and heating codes written with solid fuel (coal) installations in mind where strong drafts are needed. As a result, more draft is often provided than is needed for non-solid fuels. The result is that more air than necessary is drawn into the combustion chamber of both gas and oil heater appliances and heated room air is withdrawn by the chimney through the draft diverter on a gas-fired unit or the draft regulator on an oil-fired unit. To correct this condition, the flue restrictor 11 of the present invention may be installed on a retrofit basis in existing heating systems having excessive draft and locked in an adjusted position to fix the draft at substantially an optimum level for that particular system thereby reducing the system heat loss and conserving fuel.

Actual investigations have shown a substantial reduction in annual space heating fuel load due to use of suitable flue restriction. They have also shown that flue restriction may be used in combination with heating appliance derating (reduced burner orifice size to reduce fuel input and flame size) in order to obtain further savings. Similar results are believed to be obtainable with the particular structure of flue restrictor 11 described hereinafter. The restrictor 11 has the added advantage that it may be adjusted on the site to a selected setting that produces substantially optimum draft and vent conditions and then permanently secured or locked in that setting so that tampering to change it is extremely difficult. A further advantage is that its design enables it to be constructed of materials and to provide heat and flow conditions that minimize corrosion. An additional advantage is that it is of a relatively simple construction requiring a relatively simple calibration and assembly procedure and a minimum of tools and equipment for retrofit installation in the field.

The flue restrictor device 11 comprises three principal parts. They are inlet and outlet sections 15 and 17, which are secured together to form a housing 19, and a bladelike guillotine or gate valve 21.

The inlet section 15 has a tubular collar portion 23 of uniform diameter, circular cross section which terminates at its downstream end in an annular, radially extending, circular flange 25. The outlet section 17 has a tapered collar portion 27 of circular cross section which has, at its upstream end, an annular, radially extending, circular flange 29 corresponding to flange 25. The two flanges 25 and 29 are secured together in a substantially gas tight joint by welding, fast stitching, or any suitable fastening means as indicated at "x" in the drawings. This forms the housing 19 in which the inlet and outlet portions are coaxial and provide a straight through passage 31 for gas flow. Each section 15 and 17 is preferably of integral or one piece construction and formed of relatively thin sheet metal, preferably corrosion resisting, such as stainless steel. For example, the sections 15 and 17 may be made of 304 or 304L stainless steel, 0.018 inches thick.

Figure 3:
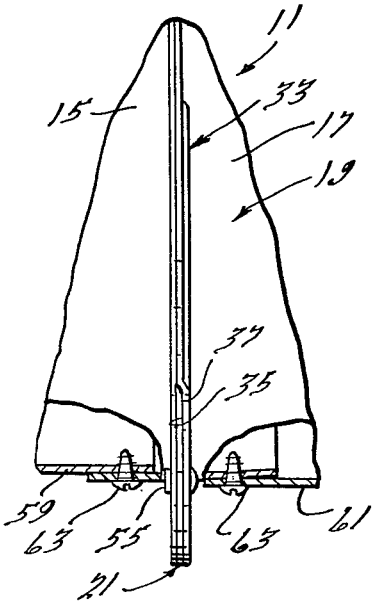
FIG. 3 is a perspective-exploded view of the three main parts of the flue restrictor of FIG. 2 with the gate valve oriented for calibration.

The gate valve 21 fits in a guideway 33 in the joint between flanges 25 and 29 so that it may be projected into the passage 31. To provide optimum sealing, the guideway 33 is preferably formed entirely in the outlet or downstream section 17 and in its flange 29, as seen best in FIG. 3. It comprises an upset or offset portion in the flange 29 of a depth and width substantially equal to the thickness and width of the gate valve plate 21. The offset has a flat bottom 35 and straight, symmetrical, parallel sides 37 which, with flange 25, define slots 39 on the inner and outer surfaces of the housing 19 through which the flat gate valve is slidable in a radial direction with respect to the axis of the housing. The sides are tangent to the inner diameter of the housing so that the width of the guideway is substantially the same as the diameter of the passage 31.

Figure 4:
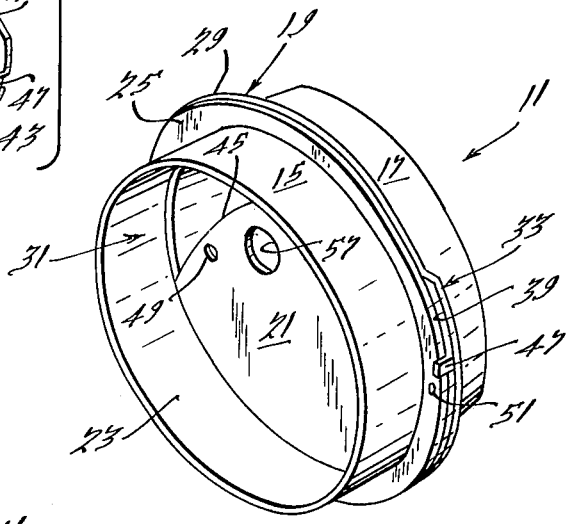
FIG. 4 is an assembled view in perspective of the parts of FIG. 3.

The gate valve 21 has straight, parallel sides 41 which extend between the restrictor end 43 and the locking end 45 of the valve. The valve is of uniform thickness and its outside dimensions are symmetrical about both longitudinal and transverse axes lying on the plate. The valve ends 43 and 45 are preferably in the form of identical circular arcs having the same radius as the circular outer edge of flange 25. As shown in FIG. 4, the overall length of the valve 21 is preferably substantially less than that of passage 31 so that it cannot be used to completely close off the passage. The overall length is also preferably less than the width of the valve between the sides 41 to facilitate proper assembly. The width of the valve corresponds to the width of the guideway and is substantially the same as the inner diameter of the housing.

The restrictor or control end 43 of the gate 21 has a pair of angularly separated tabs 47 deformed from the plane thereof to extend at substantially right angles and provide stop means to limit insertion of the end 45 of the plate into the housing 19, as illustrated in FIG. 4. The lock end 45 of the gate 21 has a pair of angularly separated fastener receiving holes 49 extending through it which are intended to register with corresponding holes 51 in flange 25 and holes 53 in flange 29. Non-detachable fasteners, such as rivets 55, are preferably used to pass through openings 49, 51, and 53 and tightly and permanently secure or lock the gate valve 21 in a fixed position to housing 19, thereby making it extremely difficult to disassemble the restrictor 11 or change the position or setting of valve 21. The locking end 45 of the gate 21 also has a relatively large opening 57 through it, forming a port means for through flow of gas, which is located adjacent the bottom most part of the housing 19 when the device 11 is installed, as shown best in FIG. 8.

Figure 2:
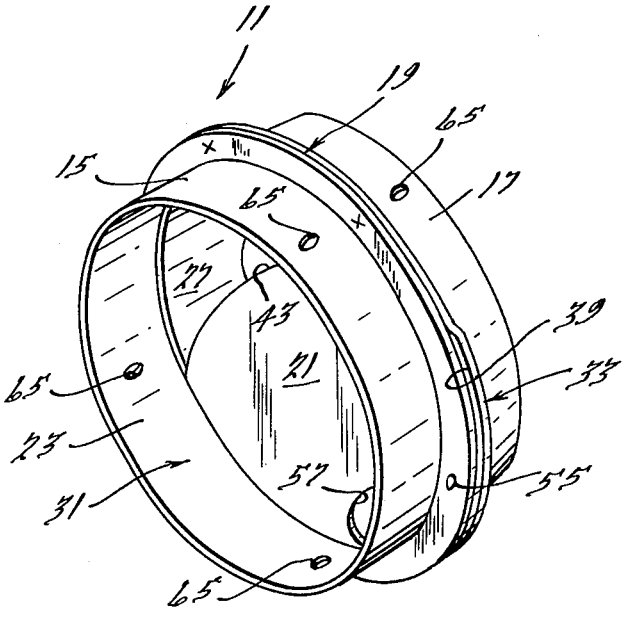
FIG. 2 is a perspective view of the flue restrictor of the invention in operative condition but removed from a flue pipe.
Figure 3:
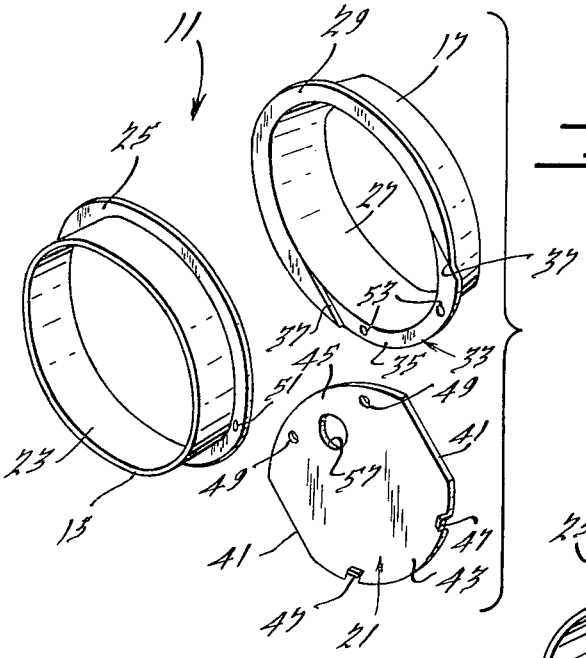
Figure 5:
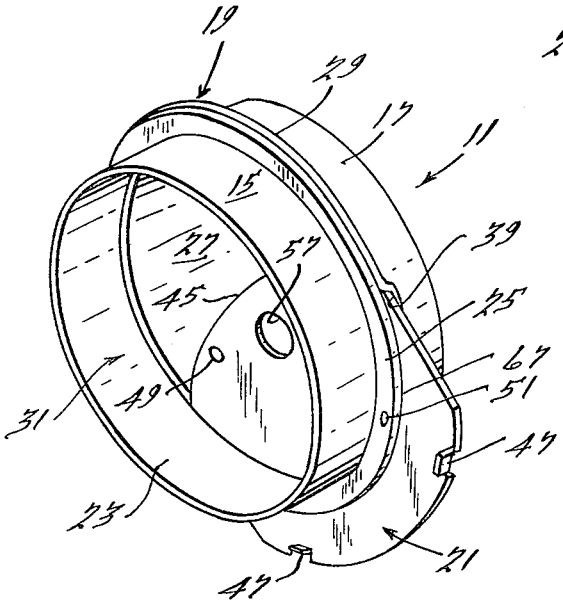
FIG. 5 is a view similar to FIG. 4 but showing the gate valve in an optimum flow position ready for the calibration marking.
Figure 10:
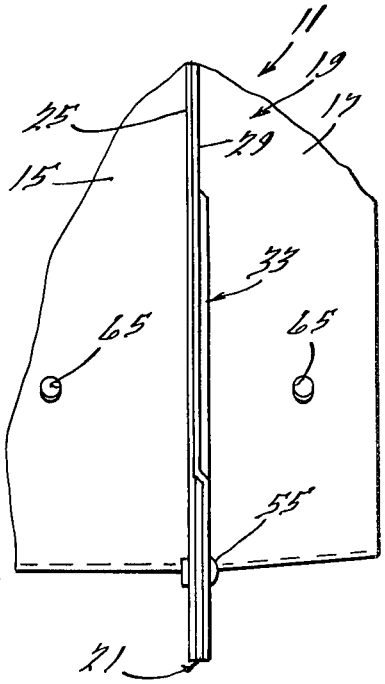
FIG. 10 is a side elevation of the restrictor of FIG. 8, partly broken away.

In use, the flue restrictor 11 is brought to the installation site in the condition of FIGS. 4 and 5 wherein the two sections 15 and 17 are joined together to form the housing 19 but the valve 21 is not yet locked in place, i.e., it is slidable in guideway 33. The installer first removes a section of flue piping 5 downstream from draft hood 13 and as close as feasible to chimney 7; and then inserts the housing 19 as a coupling in the place of the removed piping. The cylindrical inlet section 15 is telescoped on to the outside of the end of the adjacent upstream portion 59 of the flue and the tapered outlet section is telescoped inside of the end of the adjacent downstream portion 61 of the flue piping. The housing is adjusted so that the guideway is vertical. The two sections 15 and 17 are secured to the piping by suitable fasteners, such as sheet metal screws 63. Aligned sets of predrilled holes 65 in the sections 15 and 17 (shown only in FIGS. 2 and 10) may be provided to facilitate attachment of the housing to the flue piping 5. The combination of cylindrical upstream and tapered downstream sections telescoped on the outside and inside, respectively, of the adjacent flue piping facilitates installation and provides reasonable gas and air tightness at opposite ends of the unit 11.

Figure 6:
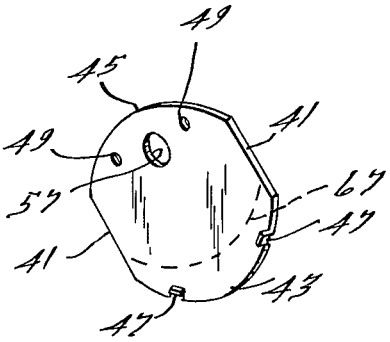
FIG. 6 is a perspective view of the marked gate valve removed from the flue restrictor housing and ready to be trimmed along the calibration marking.

The heating appliance 3 is started and operated for several minutes (or longer) until a normal, equilibrium condition for the heating system 1 is reached. Then the locking end 45 of the gate 21 is inserted into slot 39 and the valve is slidably moved upwardly in the guideway 33, the extent of upward movement being limited by engagement of tabs 47 with the outer edge of flange 25. The installer observes the effect of valve positioning on operation of the heating system and adjusts the valve vertically up and down until the desired draft and vent conditions are obtained. For example, he may determine when restriction causes spillage of combustion products into the room through draft hood 13 and then back off the valve a slight amount from that position. When he determines the proper valve position, he marks the restrictor end 43 (which is outside of the housing 19) by drawing an arc 67 on it along the outer edge of the flange 25 (FIGS. 5 and 6). The valve is then removed from the housing and cut to the required length. The gate valve 21 is preferably made of soft, trimmable metal, such as 0.033 inch thick aluminum, and metal snips or shears may be used to cut along line 67 and remove the outermost portion of restrictor end 43 containing the tabs 47.

Figure 7:
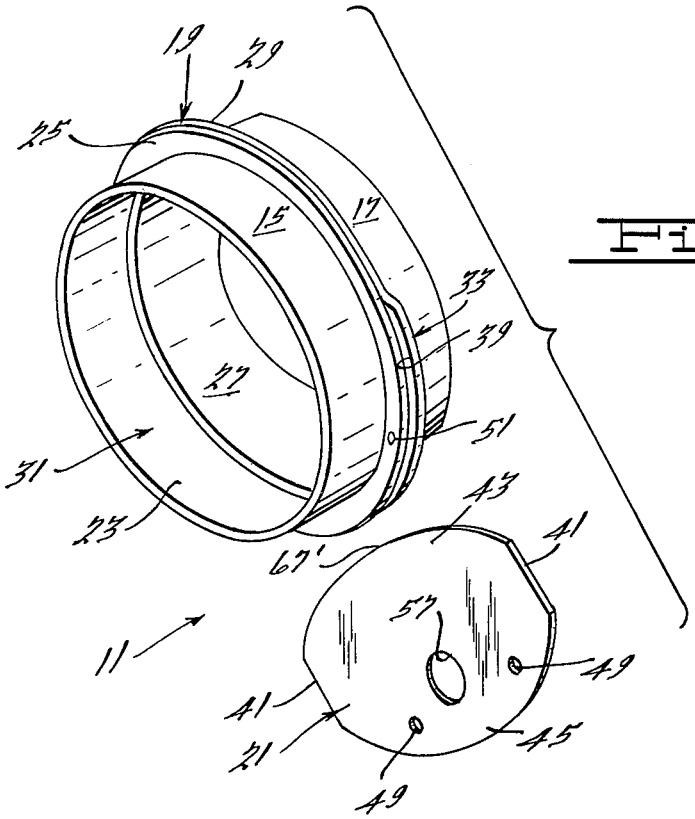
FIG. 7 is a perspective view, partially exploded, showing the inverted, calibrated gate valve ready for insertion into the housing, it being understood that this operation is performed when the housing is installed in the flue piping and that the flue pipe sections are omitted to facilitate illustration.
Figure 8:
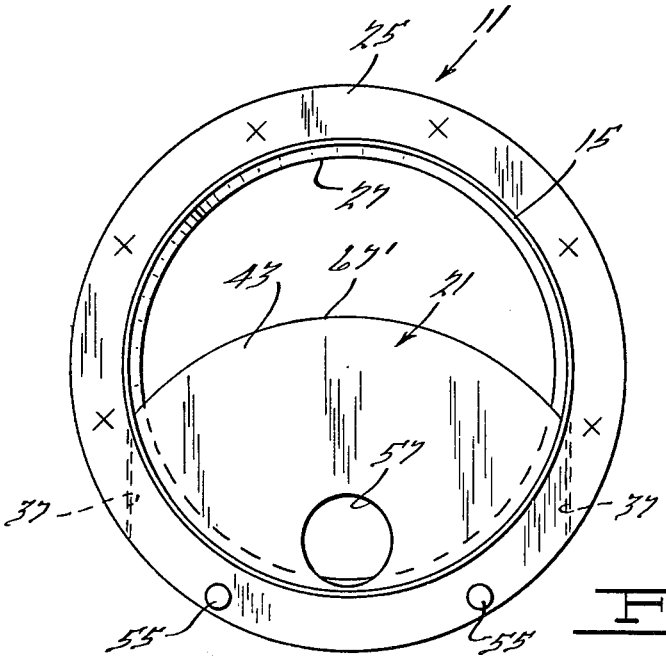
FIG. 8 is an end elevation of the flue restrictor of FIG. 7 after the calibrated gate valve has been inserted and locked in permanent position.

The installer then inverts the gate valve, i.e., reverses it end for end, as shown in FIG. 7. He inserts restrictor end 43 into slot 39 and pushes the valve 21 upwardly until holes 49 register with holes 51 and 53 of flanges 25 and 29, at which position the edge of end 45 is flush with the outer edge of flange 25. He then inserts rivets 55, or other locking fasteners, secures them in place, and locks the gate valve 21 to the housing 19 so that it is permanently secured in the position of optimum adjustment as seen in FIG. 8. It is apparent that reversal of the valve 21, after cutting along line 67 and then locking the valve in place as in FIG. 8, will result in the edge 67' of end 43 being in the same position in FIG. 8 as the edge of end 45 in FIG. 5, i.e., the position of optimum draft and vent restriction. The crescent shaped opening between the edge 67' and the top of the housing 19 and the opening 57 provide an orifice means for passage 31 that increases the resistance to flow of flue products, thereby reducing the effective draft to the desired level. The result is less air drawn into the heating appliance, less air drawn into the draft hood, and less heat loss out the chimney.

In both FIG. 5 and FIG. 8 gas can flow through the opening 57. However, in FIG. 8, the permanent, locked, and operative condition, the hole is at the bottom of the housing where condensate or solids will collect. Gas flow through the hole will, therefore, tend to carry such condensate or solids down the flue and up the chimney. Since the condensate or deposited solids may contain corrosive materials this action serves to extend the life of the parts. The pattern of gas flow in combination with the thin gauge of the sheet metal parts of the restrictor 11 enable them to heat up rapidly to a temperature above the dew point of the gas passing through the flue piping and thus tend to minimize condensation. If the sections 15 and 17 are formed of stainless steel and the gate 21 of aluminum, as is preferred, the gate will corrode away before the sections and, in this event, the system 1 is simply returned to its flow and draft condition prior to retrofit installation of the restrictor 11. These materials also have the capability of withstanding the effect of long periods of shutdown in damp environments, such as exist in many basements in the summer.

The flue restrictor 11, therefore, provides a relatively simple, self-contained device for controlling the draft in the vent connection of a heating system and for reducing heat loss by retrofit installation in existing systems with excessive draft. Installation with simple equipment and parts and relatively simple instructions may be made on the site to suit the requirements of an individual heating appliance and system. When properly installed, the restrictor is permanently set and relatively tamperproof. The preferred design and construction of the restrictor 11 is such as to combat the effect of corrosive materials in the flue products.

Modifications may be made in the specific structure shown without departing from the spirit and scope of the invention. For example, instead of using the valve 21 itself as a calibration member a separate calibration plate (not shown) could be inserted into the guideway to obtain the desired draft and vent conditions and then used to mark the valve plate 21 for cutting the restrictor end of the plate 21 to the correct size for the desired draft.

We claim:

1. A flue restrictor for installation in the flue piping of a heating system comprising a tubular flow through housing having an inlet portion and an outlet portion in series gas flow alignment with said inlet portion, a gate valve, said housing including first means defining a guideway for said gate valve, said means being located between said portions and said guideway extending transversely to the direction of flow through said portions, said gate valve having first and second generally diametrically opposed edge portions and being reversibly insertable into said guideway so that either said first or said second portion thereof comprises the leading edge of said gate valve when the same is inserted into said guideway, with said gate valve serving to restrict flow from the inlet portion to the outlet portion when permanently installed in said guideway, said first edge portion having first gate valve securing means thereon and said second edge portion being selectively removable in accordance with the magnitude of restriction to be provided by said gate valve, and second gate valve securing means adjacent the portion of said housing providing said guideway and cooperable with said first securing means for locking the gate valve to the housing in a substantially permanently fixed position.

2. A restrictor as set forth in claim 1 wherein said guideway terminates in an open slot in a side of said housing, said gate valve being symmetrical and said first and second edge portions comprising a locking end and a restrictor end, respectively, and having substantially parallel sides extending between said edge portions, substantially the entire length of said gate valve including said locking end being slidable in said guideway through said slot.

3. A restrictor as set forth in claim 2 wherein said inlet and outlet portions are substantially circular in cross section and substantially coaxial and said ends of the gate valve are shaped substantially as arcs having substantially the same radius as the outside of said housing adjacent said slot.

4. A restrictor as set forth in claim 3 wherein said gate valve and guideway have a width that is substantially the same as the outer diameter of said portions and the straight sides thereof are substantially tangent to said diameter, said valve having a greater width than length.

5. A restrictor as set forth in claim 4 wherein said gate valve has a gas flow port through it in said locking end located so that it is adjacent the housing when the gate valve is locked to the housing.

6. A restrictor as set forth in claim 2 wherein said gate valve has stop means at the restrictor end thereof to limit insertion of the valve into said guideway with the locking end as the leading end, a portion of the restrictor end being removable so that the stop means may be removed from the valve whereby the valve is slidable in said guideway with the restrictor end as the leading end.

7. A restrictor as set forth in claim 1 wherein said gate valve has a gas flow port through it located so that it is adjacent the housing when the gate valve is locked to the housing.

8. A restrictor as set forth in claim 1 wherein said housing comprises a tubular inlet section forming said inlet portion and a tubular outlet section forming said outlet portion, said sections having radial end flanges secured together to form said housing, said guideway being formed in said flanges.

9. A restrictor as set forth in claim 8 wherein said second means provides for locking of the gate valve to said flanges.

10. A restrictor as set forth in claim 8 wherein one of said sections is adapted to telescopically fit on the outside of a portion of flue piping and the other is adapted to telescopically fit inside of a portion of flue piping.

11. A restrictor as set forth in claim 10 wherein the inlet section is adapted to fit on the outside of a portion of the piping.

12. A restrictor as set forth in claim 8 wherein said guideway forms a slot opening out of the bottom of said flanges, said first edge portion of said gate valve comprising a locking end and said second edge portion comprising a restrictor end, said gate valve including substantially straight sides extending between said locking and restrictor ends substantially the entire length of said gate valve and being slidable in said guideway through said slot, said locking end and said flanges each having means therein forming a part of said second means.

13. A restrictor as set forth in claim 12 wherein said locking end and said flanges have alignable rivet holes providing said means thereon to form a part of said second means.

14. A restrictor as set forth in claim 12 wherein said flanges are substantially circular and said gate valve is substantially symmetrical and the locking end thereof is insertable in said slot and slidable in said guideway, the ends of said gate valve being substantially circular arcs having substantially the same radius as the outer edge of said circular flanges, said guideway and gate valve having a width substantially equal to the inner diameter of said sections and sides substantially tangent to said diameter.

15. A restrictor as set forth in claim 14 wherein said gate valve has a gas flow port through the locking end located so that it is at the bottom of said guideway when the gate valve is locked to the housing.

16. A restrictor as set forth in claim 15 wherein said gate valve is a flat sheet metal plate and said inlet and outlet sections are formed of sheet metal, said guideway comprising an upset portion in the flange of the outlet section.

17. A restrictor as set forth in claim 16 wherein said sections are formed of material that is more resistant to corrosion than the material forming the gate valve.

18. A restrictor as set forth in claim 17 wherein said locking end and said flanges have alignable rivet holes providing said means thereon to form a part of said second means.

19. A restrictor as set forth in claim 18 wherein said gate valve has stop means at the restrictor end thereof to limit insertion of the valve into said guideway with the locking end as the leading end, a portion of the restrictor end being removable so that the stop means may be removed from the valve whereby the valve is slidable in said guideway with the restrictor end as the leading end.

20. A restrictor as set forth in claim 1 wherein said housing is formed of stainless steel sheet and said gate is formed of aluminum sheet.

21. The method of reducing the draft in a heating system using non-solid fuel which comprises installing a housing in the flue piping of the system, said housing having a slot through the side thereof, inserting a symmetrical platelike gate valve having first and second ends through the slot so that a first end thereof projects into piping, said first end of said gate valve having first securing means thereon, with the heating system in operation positioning said valve so that the desired draft is obtained in the piping and marking the valve along the outside of said housing adjacent said slot, removing the valve from said housing and cutting the second end of the valve off along said marking to form a cut end, reversing the valve end for end and inserting said valve into said slot with said cut end as the leading end, positioning said valve so that the first end is substantially flush with said housing, and securing said valve to the housing by connecting said first securing means to second securing means on said housing, whereby to lock said valve in position.

22. A method of reducing the draft in the flue piping of a heating system which comprises installing a housing in said piping having a valve receiving gap in the sidewall thereof opening out of the bottom of the housing, while operating the system inserting one end of a valve member through said gap into said piping to determine the desired position of the valve member in said gap, said one end of said valve member having first valve securing means thereon, cutting said valve in accordance with said determination, inserting said cut valve into said housing through said gap to said position, and locking said valve to said housing by interconnecting said first securing means to second securing means on said housing.

23. A method for calibrating a gate valve-type flue restrictor in a heating system, said restrictor comprising a housing having a slot through the side thereof and a symmetrical gate valve slidable within said slot, said gate valve having first and second generally diametrically opposed edge portions, said first edge portion having first gate valve securing means thereon and said second edge portion being selectively removable in accordance with the magnitude of restriction to be provided by said gate valve, comprising the steps of:

operating said heating system;

positioning said valve so that a desired draft is obtained in the flue;

marking the valve along the outside of said housing adjacent said slot;

removing the valve from said housing and cutting the gate valve along said marking to form a cut end;

reversing the gate valve and inserting said gate valve into said slot with said cut end as the leading end;

affixing said gate valve to said housing by securing said first securing means on said gate valve to second securing means on said housing, whereby to substantially permanently lock said valve to said housing.

24. An assembly for restricting the flow of heat at the flue portion of a non-solid fuel heating system comprising:

piping means for passing the exhaust gas of said heating system to the atmosphere;

a housing secured to said piping means at an intermediate location thereof, having an inlet portion and an outlet portion in series gas flow alignment with the inlet portion, said housing including, first means defining a guideway for a gate valve, said means being located between said inlet and outlet portions and said guideway extending transversely to the direction of flow through said portions, an adjustable gate valve transversely slidable in said guideway and operative to restrict flow from the inlet portion to the outlet portion, said gate valve having first and second generally diametrically opposed edge portions, said first edge portion having first gate valve securing means thereon and said second edge portion being selectively removable in accordance with the magnitude of restriction to be provided by said gate valve, said first edge portion having first gate valve securing means thereon and said second edge portion being selectively removable in accordance with the magnitude of restriction to be provided by said gate valve, second gate valve securing means on said housing cooperable with said first securing means for locking the gate valve to the housing in an unmodifiable fixed position, and aperture means in said gate valve located adjacent the inner wall of said housing when said gate valve is locked in said fixed position by said second means.

* * * * *